United States Patent [19]

Vanelli

[11] Patent Number: 4,515,556

[45] Date of Patent: May 7, 1985

[54] COMBINED LIGHTER AND MOUTH SPRAY

[75] Inventor: Johnny Vanelli, La Guna Nigel, Calif.

[73] Assignee: Optimum Manufacturing Inc., Denver, Colo.

[21] Appl. No.: 517,471

[22] Filed: Jul. 28, 1983

[51] Int. Cl.[3] ..... F23Q 1/02

[52] U.S. Cl. ..... 431/253; D27/38

[58] Field of Search ..... 431/253; D27/38

[56] References Cited

U.S. PATENT DOCUMENTS

| | | | |
|---|---|---|---|
| D. 124,449 | 12/1940 | Flato . | |
| D. 152,386 | 1/1949 | Zelenka . | |
| D. 155,348 | 9/1949 | Kuhnl . | |
| D. 157,038 | 1/1950 | Florman . | |
| D. 157,238 | 2/1950 | Cotter . | |
| D. 163,534 | 6/1951 | Monturo | D27/38 |
| D. 227,297 | 6/1973 | Springel . | |
| D. 254,151 | 2/1980 | Wolff . | |
| 2,358,955 | 9/1944 | Weston . | |
| 4,328,911 | 5/1982 | Kickerbocker | 222/402.13 |

*Primary Examiner*—Carroll B. Dority, Jr.

*Attorney, Agent, or Firm*—Barry E. Sammons

[57] ABSTRACT

A case includes one chamber which houses a lighter and a second chamber which houses a replaceable breath spray unit. The operating ends of the lighter and breath spray unit extend from opposite ends of the case, and an actuator cap retains the breath spray unit in place and enables it to be easily operated.

5 Claims, 5 Drawing Figures

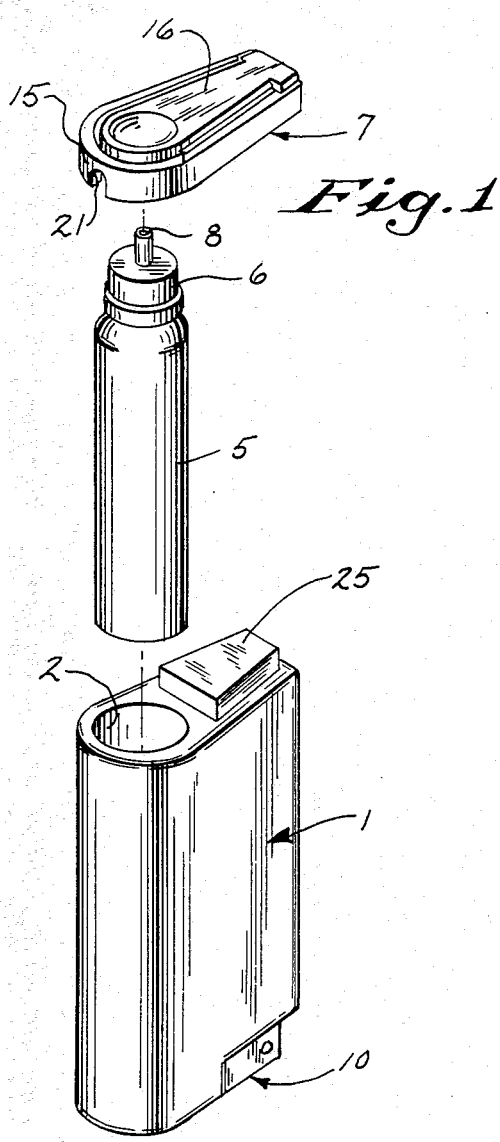
Fig. 1
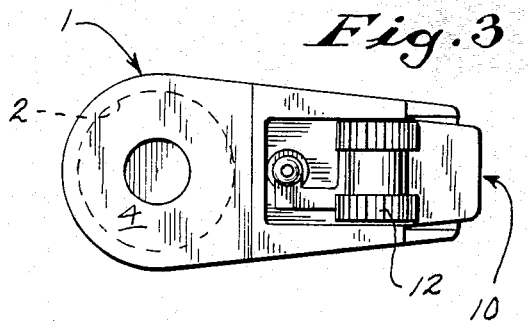
Fig. 3
Fig. 2
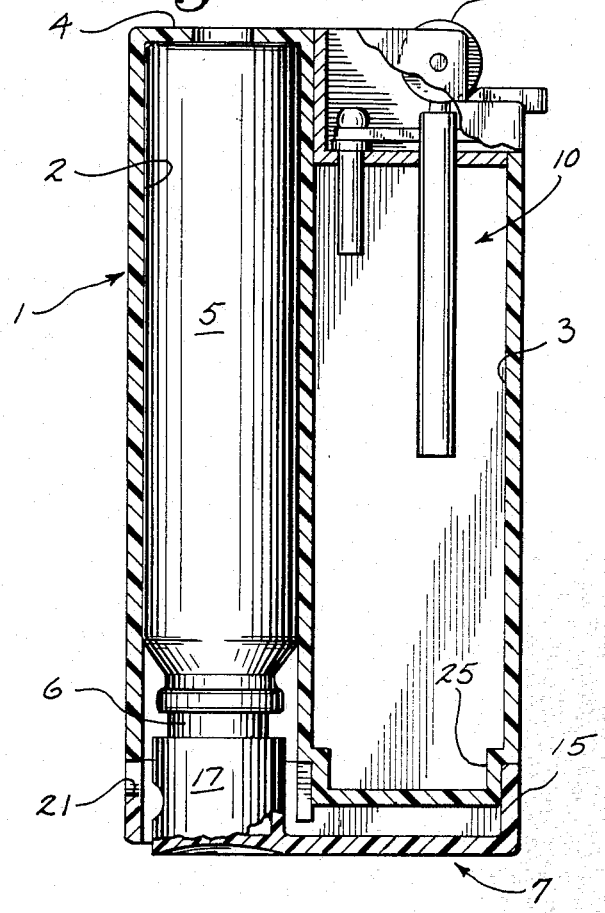
Fig. 5
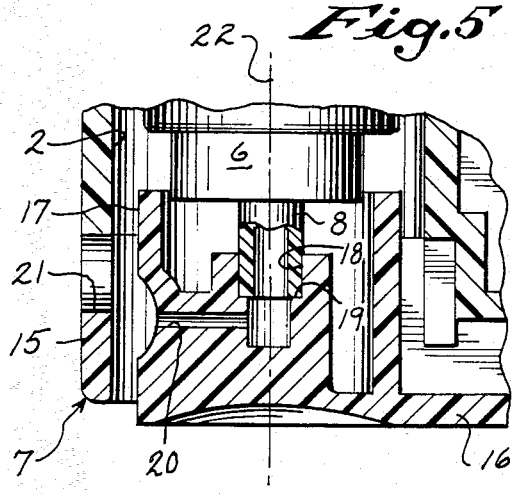
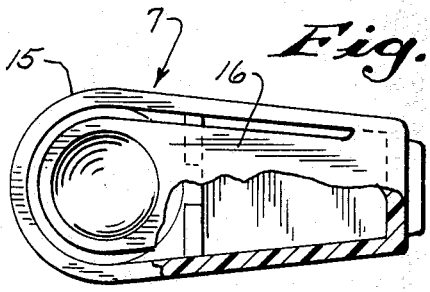
Fig. 4

COMBINED LIGHTER AND MOUTH SPRAY

BACKGROUND OF THE INVENTION

The field of the invention is compact cigarette lighters suitable for carrying in the pocket or purse.

Compact, low cost cigarette lighters have been in public use for many years. As illustrated in U.S. Pat. Nos. Des. 124,449; Des. 152,386; and Des. 254,151, such lighters have been packaged in a number of forms. In some instances, they have been packaged with other functional elements such as flashlights, lipstick, powder compacts, watches and cigarette cases.

In recent years pressurized breath, or mouth, sprays have been sold commercially by a number of manufacturers. Such mouth sprays are packaged in small cylindrical containers which which can easily be carried in a pocket or purse. These sprays contain a substantial percentage of flammable ingredients which are flavored and are contained under pressure for ease of use.

SUMMARY OF THE INVENTION

The present invention relates to a combined lighter and breath spray which is compact and convenient and safe to use. More specifically, the invention includes an elongated case which defines a pair of side-by-side chambers which extend along substantially the entire length of the case, a lighter disposed in one of the chambers and having an operating mechanism which extends from one end of the case, and a breath spray disposed in the other chamber and having an operating end which extends from the other end of the case.

A general object of the invention is to provide a packaged lighter and breath spray which is easy and safe to use. The case fits comfortably in the user's hand and the respective operating elements extend from opposite ends. It is extremely difficult to operate both the lighter and breath spray simultaneously, and the user must, therefore, make a clear and conscious choice between the two.

Another object of the invention is to enable the breath spray to be replaced. The case includes a removable cap which retains the breath spray container and valve in the case, but which can be removed to enable the breath spray unit to be replaced. The cap may form part of the operating mechanism on the breath spray unit to conserve space and to provide an aesthetically pleasing appearance.

The foregoing and other objects and advantages of the invention will appear from the following description. In the description, reference is made to the accompanying drawings which form a part hereof, and in which there is shown by way of illustration a preferred embodiment of the invention. Such embodiment does not necessarily represent the full scope of the invention, however, and reference is made therefore to the claims herein for interpreting the scope of the invention.

BRIEF DESCRIPTION OF THE DRAWINGS

FIG. 1 is a perspective view of the combined lighter and breath spray;

FIG. 2 is a side elevation view with parts cut away of the combined lighter and breath spray of FIG. 1;

FIG. 3 is a top view showing the operating end of the lighter;

FIG. 4 is a bottom view showing the operating end of the breath spray; and

FIG. 5 is a partial view of a valve actuator cap which forms part of the breath spray of FIG. 2.

DESCRIPTION OF THE PREFERRED EMBODIMENT

Referring particularly to FIGS. 1 and 2, the invention includes an elongated molded plastic case 1 which defines two chambers 2 and 3 that extend nearly its entire length. The chamber 2 is circular cylindrical in shape and it is substantially enclosed at one end by an end wall 4. A breath spray unit 5 with integral metering valve 6 is received in the chamber 2. A valve actuator cap 7 covers a valve actuation stem 8 on the breath spray unit 5 and the cap 7 is releasably retained to the end of the case 1.

Disposed in the other chamber 3 is a lighter 10. Unlike the breath spray unit 5, the lighter 10 is an integral part of the case 1, with the chamber 3 serving as the container for the lighter fuel. The operating end 11 of the lighter 10 is located at the opposite end of the case 1 from the operating end of the breath spray unit 5. As a result, it is very difficult to operate the thumbwheel 12 on the lighter 10 and at the same time operate the breath spray metering valve 6. It is also difficult to mistake one operating device from the other since they function quite differently.

Referring particularly to FIGS. 2, 4 and 5, the valve actuator cap 7 is formed as an integrally molded structure which includes a skirt portion 15 that extends around its entire perimeter. The skirt 15 forms a loop which is shaped to match the contour of the case 1 and which thereby provides an aesthetically pleasing appearance when the cap 7 is in place. An actuator arm 16 is disposed in the loop and it has one end which is integrally formed to the skirt 15. The other end of the actuator arm 16 is free to move along an operating axis 22. Integrally molded on the free end of this arm 16 is a cylindrical valve actuator 17 which extends through the skirt 15 and into engagement with the valve stem 8 on the breath spray unit 5. The stem 8 is received in a central opening 18 formed in the actuator 17, and a constriction in this central opening 18 forms a stop 19 which abuts the end of the valve stem 8. A passage 20 intersects the central opening 18 and extends radially outward therefrom through the valve actuator 17. A spray opening 21 is formed through the skirt 15 and is aligned with the passage 20 in the valve actuator 17.

The breath spray 5 is operated by depressing the end of the actuator arm 16. The arm 16 is flexible and is biased to extend slightly above the plane of the skirt 15 in its unactuated, or rest, position. When the actuator arm is depressed by the user, the valve actuator portion 17 is translated along the operating axis 22 of the breath spray unit 5. The valve stem 8 is thus depressed, and atomized fluid flows out of the stem 8 and through the central opening 18, the passage 20 and spray opening 21. When the actuator arm 16 is released, the return force exerted by the valve stem 8 returns the actuator arm 16 to its rest position.

As shown best in FIG. 1, the valve actuator cap 7 is retained in place on the end of the case 1 by a protrusion 25. The protrusion 25 is contoured to fit snuggly within the space defined by the skirt 15 on the actuator cap 7. The cap 7 may thus be placed over the protrusion 25 and retained in place by the frictional engagement of the skirt 15 and the protrusion 25 and the frictional engagement of the valve stem 8 with the central opening 18 of the valve actuator 17. The actuator cap 7 may be pulled free of the case 1, a replacement breath spray unit 5 inserted into the chamber 2, and the actuator cap 7 replaced into position over the protrusion 25 and valve stem 8.

I claim:

1. A combined lighter and breath spray which comprises:

an elongated case which defines a pair of side-by-side chambers that extend along substantially the entire length of the case;

a lighter attached to the case and disposed in one of the chambers with its operating end extending from one end of the case; and a breath spray unit disposed in the other chamber and having an operating end which extends from the other end of the case, said breath spray unit including a container which may be removed from the case and replaced by another similar container, in which the container is retained in said other chamber by an actuator cap attached to said other end of the case, and in which the container includes a valve having a valve stem which extends along an operating axis toward said other end of the case, and the actuator cap includes a valve actuator which engages the valve stem and which may be depressed by a user to operate the valve in the breath spray unit and convey the atomized fluid emitted from the stem through an opening in the valve actuator.

2. The combined lighter and breath spray as recited in claim 1 in which the actuator cap comprises:

a skirt which forms a loop that encircles the other chamber at the operating end of the breath spray unit;

an actuator arm disposed in the loop and having one end connected to the skirt, the actuator arm having a free end;

a valve actuator formed on the free end of the actuator arm and having means for engaging a valve stem on the spray unit container to operate the breath spray unit when the actuator arm is depressed.

3. The combined lighter and breath spray as recited in claim 2 in which the valve actuator includes a central opening that receives the valve stem and channels the atomized spray released from the container to a passage which extends radially outward through the valve actuator from the central passage.

4. The combined lighter and breath spray as recited in claim 3 in which a spray opening is formed in the skirt at a position which is aligned with the passage in the valve actuator when atomized spray is released.

5. A combined lighter and breath spray which comprises:

an elongated case which defines a pair of side-by-side chambers that extend along substantially the entire length of the case;

a lighter integrally formed to the case with the lighter fuel being disposed in one of the chambers and with the operating end of the lighter extending from one end of the case; and a breath spray unit comprised of a container which slides into the other chamber of the case and an actuator cap which mounts to the other end of the case to retain the container in said other chamber and engages a valve stem on the container to enable manual operation of the breath spray unit, wherein the breath spray may be replenished by removing the container from the case and replacing it with a similar container.

* * * * *